US006398946B1

(12) United States Patent
O'Rear et al.

(10) Patent No.: US 6,398,946 B1
(45) Date of Patent: Jun. 4, 2002

(54) PROCESS FOR MAKING A LUBE BASE STOCK FROM A LOWER MOLECULAR WEIGHT FEEDSTOCK

(75) Inventors: Dennis J. O'Rear, Petaluma; Thomas V. Harris, Benicia, both of CA (US)

(73) Assignee: Chevron U.S.A., Inc., San Ramon, CA (US)

( * ) Notice: Subject to any disclaimer, the term of this patent is extended or adjusted under 35 U.S.C. 154(b) by 0 days.

(21) Appl. No.: 09/470,053

(22) Filed: Dec. 22, 1999

(51) Int. Cl.[7] ..... C10G 57/02; C10G 2/04; C07C 1/04; C07C 2/04

(52) U.S. Cl. ..... 208/64; 208/18; 208/950; 585/315; 585/326

(58) Field of Search ..... 208/64, 66, 18, 208/27, 950; 585/315, 324, 326

(56) References Cited

U.S. PATENT DOCUMENTS 4,413,153 A * 11/1983 Garwood et al. ..... 585/304
4,484,014 A * 11/1984 Nelson et al. ..... 585/255
4,527,004 A * 7/1985 Sweeney ..... 585/851
4,542,247 A * 9/1985 Chang et al. ..... 585/254
5,004,862 A * 4/1991 Hildinger et al. ..... 585/867
5,037,528 A * 8/1991 Garwood et al. ..... 208/27
5,382,739 A * 1/1995 Atkins et al. ..... 585/530
5,453,556 A * 9/1995 Chang et al. ..... 585/524
5,882,505 A * 3/1999 Wittenbrink et al. ..... 208/59
6,149,271 A * 11/2000 Strebel et al. ..... 585/520

* cited by examiner

*Primary Examiner*—Bekir L. Yildirim
(74) *Attorney, Agent, or Firm*—Burns, Doane, Swecker & Mathis, L.L.P.

(57) ABSTRACT

A process for making a lube base stock wherein a highly paraffinic feedstock (with boiling points within the range of from 258° to 1100° F.) is dehydrogenated to produce an olefinic feedstock, which is oligomerized to produce an oligomerized product, which is separated into a lighter fraction and a heavier fraction. That heavier fraction has a flash point within the lube base oil range.

19 Claims, 1 Drawing Sheet

PROCESS FOR MAKING A LUBE BASE STOCK FROM A LOWER MOLECULAR WEIGHT FEEDSTOCK

The present invention relates to a process for making a lube base stock from materials having lower molecular weights.

BACKGROUND OF THE INVENTION

Lubricant oils of high viscosity and high oxidation stability are desirable. Such materials can be prepared by hydrocracking, hydrodewaxing and hydrofinishing or another route of polymerization of normal alpha olefins (1-decene). The former route has the advantage of moderate costs, but the oxidation stability is not exceptional. As attempts are made to improve the oxidation stability by increasing the severity of the hydroprocessing steps, the yield of lube declines, as does its viscosity. The latter route gives an exceptionally stable product, but suffers the disadvantage of high cost. What is needed is a moderate cost process that generates high viscosity and highly stable products. The invention disclosed herein satisfied this objective.

SUMMARY OF THE INVENTION

The present invention provides a process for making a lube base stock from a lower molecular weight feedstock. In that process a highly paraffinic feedstock, with boiling points within the range of from 258° to 1100° F., is dehydrogenated in a dehydrogenation zone to produce an olefinic feedstock, which is oligomerized to produce an oligomerized product having a higher number average molecular weight than the olefinic feedstock. That oligomerized product is separated into a lighter fraction and a heavier fraction, the heavier fraction having a flash point within the lube base oil range. Preferably, either the oligomerized product is hydrogenated or the heavier fraction is hydrogenated, in both cases to eliminate any remaining olefins.

Preferably, the oligomerized product has at least 10% higher number average molecular weight than the initial feedstock, more preferably at least 20% higher than the initial feedstock.

Preferably, the highly paraffinic feedstock has a paraffin content of at least 75% prior to dehydrogenation. That highly paraffinic feedstock can be produced by a Fischer-Tropsch process, preferably hydrotreated prior to dehydrogenation. If feedstock is hydrotreated, skeleton isomerization can be induced during hydrotreatment.

Preferably, the olefinic feedstock has no more than 50% olefins, preferably from 10% to 50% olefins. Skeleton isomerization can be induced during that dehydrogenation step, or on the feed to the oligomerization step, or on the product from the oligomerization step.

Preferably, the heavier fraction of the oligomerized product has a viscosity of greater than 4 cSt at 40° C. and a viscosity index of above 80 (more preferably above 120). Preferably, this heavier fraction is hydrogenated.

Preferably, at least a portion of the lighter fraction of the oligomerized product is recycled to the either to the dehydrogenation zone or to the first hydrotreatment zone. If the lighter fraction is recycled to the dehydrogenation zone, the oligomerized product is preferably hydrotreated prior to the separation step. If the lighter fraction is recycled to the first hydrotreatment zone, the heavier fraction is preferably hydrotreated.

In one embodiment, a lube base stock is made by (a) using a Fischer-Tropsch process to produce a feedstock, with boiling points within the range of from 258° to 1100° F., and having a paraffin content of at least 75 weight %, (b) hydrotreating and inducing skeleton isomerization in the highly paraffinic feedstock in a first hydrotreatment zone, (c) dehyrogenating the hydrotreated highly paraffinic feedstock in a dehydrogenation zone to produce an olefinic feedstock having from 10% to 50% olefins, with the olefins being predominately internal olefins, (d) oligomerizing the olefinic feedstock to produce an oligomerized product having a higher number average molecular weight than the olefinic feedstock, (e) hydrotreating the oligomerized product in a second hydrotreatment zone;

(f) separating the oligomerized product into a lighter fraction and a heavier fraction, wherein the heavier has a viscosity of greater than 4 cSt at 40° C., a viscosity index of above 120, and a flash point within the lube base oil range, and (g) recycling the lighter fraction to said dehydrogenation zone.

In an alternative embodiment, the lighter fraction is recycled to the first hydrotreatment zone instead of to the dehydrogenation zone. In that embodiment, the hydrotreatment of the oligomerized product is not necessary. Instead, the heavier fraction is hydrotreated prior to hydrogenation.

BRIEF DESCRIPTION OF THE DRAWINGS

In order to assist the understanding of this invention, reference will now be made to the appended drawings. The drawings are exemplary only, and should not be construed as limiting the invention.

DETAILED DESCRIPTION OF THE INVENTION

Figure 1:
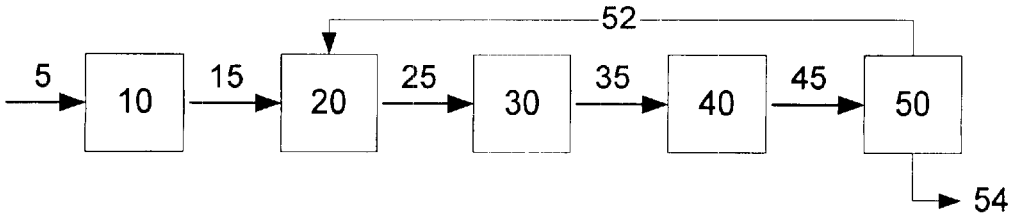
FIG. 1 shows a block diagram of a specific embodiment of a process for making a lube base stock from a lower molecular weight feedstock.

In its broadest aspect, the present invention involves a process for making a lube base stock from a highly paraffinic feedstock with boiling points within the range of from 258° to 1100° F. In that process, the highly paraffinic feedstock is dehyrogenated to produce an olefinic feedstock, the olefinic feedstock is oligomerize to produce an oligomerized product having a higher number average molecular weight than the olefinic feedstock, and the oligomerized product is separated into a lighter fraction and a heavier fraction. That heavier fraction has a flash point within the lube base oil range.

DEFINITIONS

As used herein the following terms have the following meanings unless expressly stated to the contrary:

The term "lube base oil range" refers to initial boiling points of at least 572° F. (300° C.).

The term "lube base stock" refers to hydrocarbons in the lube base oil range that have acceptable viscosity index and viscosity for use in making finished lubes. Lube base stocks are mixed with additives to form finished lubes.

The term "viscosity index" refers to the measurement defined by D 2270-93.

Unless otherwise specified, all percentages are in weight percent.

The Highly Paraffinic Feedstock

The highly paraffinic feedstock has boiling points within the range of from 258° to 1100° F. Preferably, that highly paraffinic feedstock has a paraffin content of at least 75% prior to dehydrogenation.

Preferably, the highly paraffinic feedstock is produced by a Fischer-Tropsch process. A syngas product is converted to liquid hydrocarbons by contact with a Fischer-Tropsch catalyst under reactive conditions. Depending on the quality of the syngas it may be desirable to purify the syngas prior to the Fischer-Tropsch reactor to remove carbon dioxide produced during the syngas reaction and any sulfur compounds, if they have not already been removed. This can be accomplished by contacting the syngas with a mildly alkaline solution (e.g., aqueous potassium carbonate) in a packed column. In general Fischer-Tropsch catalysts contain a Group VIII transition metal on a metal oxide support. The catalyst may also contain a noble metal promoter(s) and/or crystalline molecular sieves. Pragmatically, the two transition metals which are most commonly used in commercial Fischer-Tropsch processes are cobalt or iron. Ruthenium is also an effective Fischer-Tropsch catalyst but is more expensive than cobalt or iron. Where a noble metal is used, platinum and palladium are generally preferred. Suitable metal oxide supports or matrices which can be used include alumina, titania, silica, magnesium oxide, silica-alumina, and the like, and mixtures thereof.

Although, Fischer-Tropsch processes produce a hydrocarbon product having a wide range of molecular sizes the selectivity of the process toward a given molecular size range as the primary product can be controlled to some extent by the particular catalyst used. In the present process, it is preferred to produce $C_{20}$–$C_{50}$ paraffins as the primary product, and therefore, it is preferred to use a cobalt catalyst although iron catalysts may also be used. One suitable catalyst is described in U.S. Pat. No. 4,579,986 as satisfying the relationship.

$$(3+4R)>L/S>(0.3+0.4R),$$

wherein

L=the total quantity of cobalt present on the catalyst, expressed as mg Co/ml catalyst, S=the surface area of the catalyst, expressed as m2/ml catalyst, and R=the weight ratio of the quantity of cobalt deposited on the catalyst by kneading to the total quantity of cobalt present on the catalyst.

Preferably, the catalyst contains about 3–60 ppw cobalt, 0.1–100 ppw of at least one of zirconium, titanium or chromium per 100 ppw of silica, alumina, or silica-alumina and mixtures thereof. Typically, the synthesis gas will contain hydrogen, carbon monoxide and carbon dioxide in a relative mole ratio of about from 0.25 to 2 moles of carbon monoxide and 0.01 to 0.05 moles of carbon dioxide per mole of hydrogen. In the present process we prefer to use a mole ratio of carbon monoxide to hydrogen of about 0.4 to 1, more preferably 0.5 to 0.7 moles of carbon monoxide per mole of hydrogen with only minimal amounts of carbon dioxide; preferably less than 0.5 mole percent carbon dioxide.

In the present process the Fischer-Tropsch reaction is typically conducted at temperatures of about from 300 to 700° F. (149 to 371° C.) preferably about from 400° to 550° F. (204° to 228° C.); pressures of about from 10 to 500 psia, (0.7 to 34 bars) preferably 30 to 300 psia, (2 to 21 bars) and catalyst space velocities of about from 100 to 10,000 cc/g/hr., preferably 300 to 3,000 cc/g/hr. The reaction can be conducted in a variety of reactors for example, fixed bed reactors containing one or more catalyst beds, slurry reactors, fluidized bed reactors, or a combination of different type reactors. The Fischer-Tropsch reaction product can be separated into the desired product fractions, e.g., a gasoline fraction (B.P. about 68–450° F./20–232° C.) a middle distillate fraction (B.P. about 450–650° F./232–343° C.) a wax fraction (B.P. about 650–1100° F./539° C.) primarily containing $C_{20}$ to $C_{50}$ normal paraffins with a small amount of branched paraffins and a heavy fraction (B.P. above about 1100° F.) and tail gases. With the exception of the wax fraction, the other fractions are largely a matter of choice depending on the products desired; for example, a single liquid fuel fraction may be taken off comprising both gasoline and middle distillate may be taken off or multiple fuel cuts as well as heavy cuts may be taken. In some cases, for example, where a bubble slurry reactor is used, both liquid and gaseous product streams may be taken off. The gaseous stream will contain tail gases and may also contain gasoline fuel fraction. The gasoline fraction can be recovered using vapor/liquid separators. The tail gas primarily containing hydrogen and $C_1$ to $C_4$ paraffins can be used as fuel gas or can be treated to remove carbon dioxide and used as a hydrogen or alkane recycle stream.

In a preferred embodiment, the Fischer-Tropsch reaction is conducted in a bubble column slurry reactor. In this type of reactor synthesis gas is bubbled through a slurry comprising catalyst particles in a suspending liquid. Typically the catalyst has a particle size of about from 10–110 microns, preferably about from 20–80 microns, more preferably about from 25–65 micron and a density of about from 0.25 to 0.9 g/cc preferably about from 0.3–0.75 g/cc. The catalyst typically comprises one of the aforementioned catalytic metals, preferably cobalt on one of the aforementioned catalyst supports. Preferably the catalyst comprises about 10% to 14% cobalt on a low density fluid support, for example alumina, silica and the like having a density within the ranges set forth above for the catalyst. Since, the catalyst metal may be present in the catalyst as oxides the catalyst is typically reduced with hydrogen prior to contact with the slurry liquid. The starting slurry liquid is typically a heavy hydrocarbon having a viscosity high enough to keep the catalyst particles suspended, typically a viscosity between 4–100 centistokes at 100° C.) and a low enough volatility to avoid vaporization during operation, typically an initial boiling point range of about from 350 to 550° C. The slurry liquid is preferably essentially free of contaminants such as sulfur, phosphorous or chlorine compounds. Thus initially, it may be desirable to use a synthetic hydrocarbon fluid such as a synthetic olefin oligomer as the slurry fluid. Ultimately, a paraffin fraction of the product having the desired viscosity and volatility is typically recycled as the slurry liquid. The slurry typically has a catalyst concentration of about 2%–40% catalyst, preferably 5%–20% and more preferably 7%–15% catalyst based on the total weight of the catalyst, i.e. metal plus support. The syngas feed typically has hydrogen to carbon monoxide mole ratio of about from 0.5 to 4 moles of hydrogen per mole of carbon monoxide, preferably about from 1 to 2.5 and more preferably about 1.5 to 2.

The bubble slurry reactor is typically operated at temperatures within the range of 150–300° C., preferably 185 to 265° C. and more preferably 210–230° C. and pressures within the range of 1 to 70 bar, preferably 6–35 bar and most preferably 10 to 30 bar (1 bar=14.5 psia). Typical synthesis gas linear velocity ranges in the reactor from about 2 to 40 cm per sec. preferably 6 to 10 cm per sec. Additional details regarding bubble column slurry reactors can, for example, be found in Y. T. Shah et al., Design Parameters Estimations for Bubble Column Reactors, AIChE Journal, 28 No. 3 pp. 353–379 (May 1982); Ramachandran et al., Bubble Column Slurry Reactor, Three-Phase Catalytic Reactors Chapter 10, pp. 308–332 Gordon and Broch Science Publishers (1983); Deckwer et al., Modeling the Fischer-Tropsch Synthesis in the Slurry Phase, Ind. Eng. Chem. Process Des. Dev. v 21, No. 2, pp. 231–241 (1982); Kolbel et al., The Fischer-Tropsch Synthesis in the Liquid Phase, Catal. Rev.-Sci. Eng., v. 21(n), pp. 225–274 (1980) and U.S. Pat. No. 5,348,982, all of which are hereby incorporated by reference in their entirety.

The gaseous reaction product from the Fischer-Tropsch bubble slurry reactor comprises hydrocarbons boiling below about 650° F. (e.g., tail gases through middle distillates). The liquid reaction product is recovered as or with the slurry and comprises hydrocarbons boiling above about 650° F., e.g., vacuum gas oil through heavy paraffins. The minus 650° F. product can be separated into a tail gas fraction and a condensate fraction, i.e., about $C_5$ to $C_{20}$ normal paraffins and higher boiling hydrocarbons, using a high pressure and/or lower temperature vapor-liquid separator or low pressure separators or a combination of separators. The tail gas fraction may be used as described above. The condensate fraction can be fractionated into the desired product fraction; e.g., gasoline, light middle distillate or more preferably is upgraded by hydrocracking. The F-T fraction boiling above about 650° F., after removal of the particulate catalyst, is typically separated into a wax fraction boiling in the range of about 650° F.–1100° F. primarily about containing $C_{20}$ to $C_{50}$ linear paraffins with relatively small amounts of higher boiling branched paraffins, one or more liquid fuel fractions boiling below about 650° F. and one or more fractions boiling above about 1100° F. Typically, the separation is effected by fractional distillation. A portion of the liquid reaction product is preferably recycled to provide slurry liquid.

Alternatively, if the Fischer-Tropsch reaction is designed to produce a single process stream, for example, by using fixed bed reactor, then the entire product stream may be fractionated generally after first removing hydrogen and preferably other tail gases as well. This can be done by passing the product stream through one or more vapor-liquid separators prior to fractionation.

Although the invention is described herein in terms of a Fischer-Tropsch reaction product or a Fischer-Tropsch process the invention also applies to the various modifications of the literal Fischer-Tropsch process by which hydrogen (or water) and carbon monoxide (or carbon dioxide) are converted to hydrocarbons (e.g. paraffins, ethers etc.) and to the products of such processes. Thus the term Fischer-Tropsch type product or process is intended to apply to Fischer-Tropsch processes and products and the various modifications thereof and the products thereof. For example, the term is intended to apply to the Kolbel-Engelhardt process typically described by the reactions $$3CO+H_2O \rightarrow —CH_2— +2CO_2$$

$$CO_2+3H_2 \rightarrow —CH_2— +2H_2O$$

Purification Processes

Preferably, the highly paraffinic feedstock is purified (e.g., hydrotreated in a hydrotreating zone) to remove oxygen and other impurities to form a treated waxy fraction. Such hydrotreating zones are well known in the industry. Other treatments useful for removing oxygen and other impurities include, but are not limited to, adsorption, and extraction.

Hydrogenation catalysts can be used for the purification. For example, a noble metal from Group VIIIA according to the 1975, rules of the International Union of Pure and Applied Chemistry, such as platinum or palladium on an alumina or siliceous matrix, or unsulfided Group VIIIA and Group VIB, such as nickel-molybdenum or nickel-tin on an alumina or siliceous matrix, is a suitable catalyst. U.S. Pat. No. 3,852,207 granted Mar. 26, 1973, to Stangeland et al, describes a suitable noble metal catalyst and mild conditions, and is herein incorporated by reference. Other suitable catalysts are detailed, for example, in U.S. Pat. Nos. 4,157,294, and 3,904,513. The non-noble metal (such as nickel-molybdenum) hydrogenation metal are usually present in the final catalyst composition as oxides, or more preferably or possibly, as sulfides when such compounds are readily formed from the particular metal involved. Preferred non-noble metal overall catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The noble metal (such as platinum) catalysts contain in excess of 0.01% metal, preferably between 0.1 and 1.0% metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e.; molybdenum and tungsten can be combined with the refractory oxide by impregnation, co-mulling or co-precipitation. Although these components can be combined with the catalyst matrix as the sulfides, that is generally not the case. They are usually added as a metal salt, which can be thermally converted to the corresponding oxide in an oxidizing atmosphere or reduced to the metal with hydrogen or other reducing agent. If necessary, the non-noble metal composition can then be sulfided by reaction with a sulfur donor such as carbon bisulfide, hydrogen sulfide, hydrocarbon thiols, elemental sulfur, and the like.

The matrix component can be of many types including some that have acidic catalytic activity. Ones that have activity include amorphous silica-alumina or may be a zeolitic or non-zeolitic crystalline molecular sieve. Examples of suitable matix molecular sieves include zeolite Y, zeolite X and the so called ultra stable zeolite Y and high structural silica:alumina ratio zeolite Y such as for example described in U.S. Pat. Nos. 4,401,556, 4,820,402 and 5,059,567. Small crystal size zeolite Y, such as described in U.S. Pat. No. 5,073,530 can also be used. The disclosures of all of which patents are hereby incorporated by reference in their entirety. Non-zeolitic molecular sieves which can be used include, for example silicoaluminophosphates (SAPO), ferroaluminophosphate, titanium aluminophosphate and the various ELAPO molecular sieves described in U.S. Pat. No. 4,913,799 and the references cited therein. Details regarding the preparation of various non-zeolite molecular sieves can be found in U.S. Pat. No. 5,114,563 (SAPO); U.S. Pat. No. 4,913,799 and the various references cited in U.S. Pat. No. 4,913,799, hereby incorporated by reference in their entirety. Mesoporous molecular sieves can also be included, for example the M41S family of materials (J. Am. Chem. Soc.

1992, 114, 10834–10843), MCM-41 (U.S. Pat. Nos. 5,246, 689, 5,198,203, 5,334,368), and MCM-48 (Kresge et al., Nature 359 (1992) 710.)

Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides naturally occurring clays which can be composite with the catalyst include those of the montmorillonite and kaolin families. These clays can be used in the raw state as originally mined or initially subjected to calumniation, acid treatment or chemical modification.

Furthermore more than one catalyst type may be used in the reactor. The different catalyst types can be separated into layers or mixed.

Typical hydrotreating conditions vary over a wide range. In general, the overall LHSV is about 0.25 to 2.0, preferably about 0.5 to 1.0. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures range from about 300° F. to about 750° F., preferably ranging from 450° F. to 600° F.

Skeleton Isomerization

To control the pour and cloud point of the final product to the desired value, skeletal isomerization of the paraffinic feedstock, intermediate olefin steams, or final product can be used.

Skeleton isomerization can be induced in the final product by use of reactions in several locations. These include reactions of the paraffins or intermediate olefin stream:

- On the initial paraffins while highly paraffinic feedstock is being hydrotreated, or
- On the olefins and paraffins during the dehydrogenation step, or
- On the olefins in the dehydrogenated product in a separate reactor, or
- On the olefins during the oligomerization step, or
- On the olefins in the oligomerized product in a separate reactor, or
- On the olefins and paraffins during the hydrotreating of the product from the oligomerization reactor, or
- On the paraffins during hydrotreatment of the heavy fraction, or
- During a combination of those steps.

If it is desirable to introduce skeletal isomerization during the paraffinic feedstock hydrotreating step, or during the hydrotreating of the product from the oligomerization reactor, or during the hydrotreating of the final lube base oil range hydrocarbons, the matrix of the catalyst is chosen to facilitate this reaction. Detailed descriptions of catalysts that do this reaction are shown in U.S. Pat. Nos. 5,282,958, 5,246,566, 5,135,638 and 5,082,986 and are herein incorporated as a reference. A molecular sieve is used as one component in the matrix. The sieve has pores of less than 7.1 Å, preferably less than 6.5 Å; and having at least one pore diameter greater than 4.8 Å, and having a crystal size no more than about 0.5 microns. The catalyst is further characterized in that it has sufficient acidity to convert at least 50% of hexadecane at 370° C., and exhibits a 40 or greater isomerization selectivity ratio as defined in U.S. Pat. No. 5,282,958 at 96% hexadecane conversion. Specific examples of molecular sieves which satisfy these requirements are ZSM-12, ZSM-21, ZSM-22, ZSM-23, ZSM-35, ZSM-38, ZSM-48, ZSM-57, SSZ-32, SSZ-35, Ferrierite, L-type zeolite, SAPO-11, SAPO-31, SAPO-41, MAPO-11 and MAPO-31.

If it is desired to induce skeletal isomerization of the olefinic intermediates (either the product from the paraffin dehydrogenation step, or the oligomerization step), U.S. Pat. Nos. 5,741,759 and 5,965,783 describe catalysts and process conditions to do this, and are incorporated herein as references. Molecular sieves as defined above in the paraffin skeletal isomerization step may be used as catalyst, however metals, such as noble metals, are excluded from the catalyst formulation. The molecular sieve is frequently composited with a binder to form an extrudate, sphere, or pellet. Temperatures used to skeletally isomerize the olefins are between 100 and 400° C., the WHSV is between 0.2 and 10, and the pressure is typically below 500 psig, preferably below 100 psig.

The Dehydrogenation Reaction

In the dehydrogenation zone, the highly paraffinic feedstock is dehydrogenated to produce an olefinic feedstock. Skeleton isomerization can be induced during this dehydrogenation step.

Dehydrogenation processes known in the art generally have employed catalysts which comprise a noble metal, usually Pt, supported on a non-acid support, typically alumina or silica alumina. The temperature at which paraffin dehydrogenation is normally carried out is in a range from 350° to 650° C., and preferably from 400° to 550° C. The process is usually carried out at atmospheric pressure, although it is possible to operate at a pressure of several atmospheres, for example up to 10 atmospheres.

The linear paraffins are generally fed at a rate of from 0.001 to 100 volumes (calculated as a liquid) per hour for each volume of catalyst. Moreover, since the dehydrogenation reaction takes place in the presence of hydrogen gas, it is convenient to maintain the molar ratio of hydrogen to linear paraffin in the feed mixture at a value of from 1:1 to 50:1.

Preferably, the olefinic feedstock has no more than 50% olefins, preferably from 10% to 50% olefins.

Inherently, these olefins are usually predominately internal olefins.

The Oligomerization Reaction

The olefinic feedstock produced in the dehydrogenation zone is oligomerized to produce an oligomerized product having a higher number average molecular weight than initial feedstock. Preferably, the oligomerized product has a higher number average molecular weight at least 10% higher than the initial feedstock, more preferably at least 20% 10% higher than the initial feedstock. Since the oligomerization typically uses acidic catalysts, it can also promote skeletal isomerization of olefins. Thus, both oligomerization and skeletal isomerization can occur in the same process step.

Conditions for this oligomerization are between room temperature and 400° F., from 0.1 to 3 LHSV, and from 0 to 500 psig. Catalysts for oligomerization can be virtually any acidic material including zeolites, clays, resins, $BF_3$ complexes, HF, $H_2SO_4$, $AlCl_3$, ionic liquids, superacids, etc.

Zeolites are preferred because of their resistance to fouling and ease of regeneration.

The Separation of Oligomerization Product

The oligomerized product is separated into a lighter fraction and a heavier fraction. This can be done by conventional separation techniques, such as distillation.

That heavier fraction has a flash point within the lube base oil range. Preferably, the heavier fraction has a viscosity of greater than 4 cSt at 40° C. and a viscosity index of above 80 (more preferably above 120).

Preferably, at least a portion of the lighter fraction is recycled to the either to the dehydrogenation zone or to the purification zone.

Preferably, either the oligomerized product is hydrogenated or the heavier fraction is hydrogenated, in both cases to eliminate any remaining olefins. If the oligomerized product is hydrogenated, at least a portion of the light fraction preferably goes to dehydrogenation zone, or alternatively to the first purifier or fuel the heavier fraction is hydrogenated, at least a portion of the light fraction preferably goes to the dehydrogenation zone, or alternatively to the first purifier or to oligomerization zone or to fuel.

Hydrogenation of the Heavy Fraction

Preferably, the heavier fraction is hydrogenated to remove any remaining olefins. Typical conditions are between 200° and 600° F., 0.1 to 3 LHSV, and 200 to 3000 psig. Catalysts that do this reaction can be any NiMo supported catalyst or a Group VIII metal on a support. Preferred catalysts are platinum, palladium, or platinum-palladium alloys.

In one specific embodiment, as shown in FIG. 1, feedstock 5 is a highly paraffinic feedstock, with boiling points within the range of from 258° to 1100° F., produced by a Fischer-Tropsch process, wherein said highly paraffinic feedstock has a paraffin content of at least 75 weight %. Feedstock 5 is purified by hydrotreating in a first hydrotreatment zone 10, wherein skeleton isomerization is induced while the highly paraffinic feedstock is being purified to produce purified highly paraffinic feedstock 15. The purified highly paraffinic feedstock 15 is dehydrogenated in dehydrogenation zone 20 to produce an olefinic feedstock 25 having from 10% to 50% olefins. The olefins produced are predominately internal olefins. Olefinic feedstock 25 is oligomerized in oligomerization zone 30 to produce an oligomerized product 35 having a number average molecular weight at least 20% higher than that of the olefinic feedstock. The oligomerized product 35 is hydrotreated in a second hydrotreatment zone 40 to produce a hydrotreated product 45. The hydrotreated product 45 is separated in separator 50 into a lighter fraction 52 and a heavier fraction 54. The heavier fraction 54 has a viscosity of greater than 4 cSt at 40° C., a viscosity index of above 120, and a flash point within the lube base oil range. At least a portion of the lighter fraction 52 is recycled to dehydrogenation zone 20.

Figure 2:
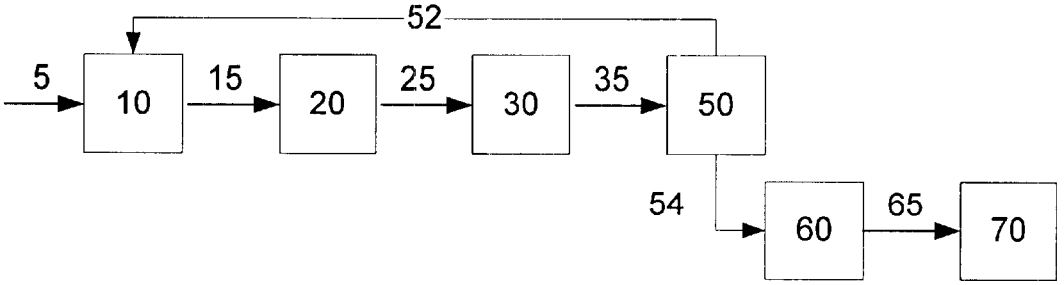
FIG. 2 shows a block diagram of an alternative embodiment of a process for making a lube base stock from a lower molecular weight feedstock.

In another specific embodiment, as shown in FIG. 2, feedstock 5 is a highly paraffinic feedstock, with boiling points within the range of from 258° to 1100° F., produced by a Fischer-Tropsch process, wherein said highly paraffinic feedstock has a paraffin content of at least 75 weight %. Feedstock 5 is purified by hydrotreating in a first hydrotreatment zone 10, wherein skeleton isomerization is induced while the highly paraffinic feedstock is being purified to produce purified highly paraffinic feedstock 15. The purified highly paraffinic feedstock 15 is dehydrogenated in dehydrogenation zone 20 to produce an olefinic feedstock 25 having from 10% to 50% olefins. The olefins produced are predominately internal olefins. Olefinic feedstock 25 is oligomerized in oligomerization zone 30 to produce an oligomerized product 35 having a number average molecular weight at least 20% higher than that of the olefinic feedstock. The oligomerized product 35 is separated in separator 50 into a lighter fraction 52 and a heavier fraction 54. The heavier fraction 54 has a viscosity of greater than 4 cSt at 40° C., a viscosity index of above 120, and a flash point within the lube base oil range. At least a portion of the lighter fraction 52 is recycled to first hydrotreatment zone 10 and the heavier fraction 54 is hydrotreated in a third hydrotreatment zone 60 and the hydrotreated heavier fraction 65 is hydrogenated in hydrogenation zone 70.

While the present invention has been described with reference to specific embodiments, this application is intended to cover those various changes and substitutions that may be made by those skilled in the art without departing from the spirit and scope of the appended claims.

What is claimed is:

1. A process for making a lube base stock comprising:

(a) dehydrogenating a highly paraffinic feedstock, with boiling points within the range of from 258° to 1100° F., in a dehydrogenation zone to produce an olefinic feedstock;

(b) oligomerizing said olefinic feedstock to produce an oligomerized product having a higher number average molecular weight than the olefinic feedstock; and (c) separating said oligomerized product into a lighter fraction and a heavier fraction, wherein said heavier fraction has a flash point within the lube base oil range.

2. A process for making a lube base stock according to claim 1 further comprising either hydrotreating the oligomerized product prior to separation step (c) or hydrotreating the heavier fraction.

3. A process for making a lube base stock according to claim 1 wherein said oligomerized product has a number average molecular weight at least 10% higher than the olefinic feedstock.

4. A process for making a lube base stock according to claim 3 wherein said oligomerized product has a number average molecular weight at least 20% higher than the olefinic feedstock.

5. A process for making a lube base stock according to claim 1 wherein said highly paraffinic feedstock has a paraffin content of at least 75 weight % prior to dehydrogenation step (a).

6. A process for making a lube base stock according to claim 5 wherein said highly paraffinic feedstock is produced by a Fischer-Tropsch process.

7. A process for making a lube base stock according to claim 1 wherein said highly paraffinic feedstock is purified to remove oxygen and other impurities prior to dehydrogenation.

8. A process for making a lube base stock according to claim 1 wherein at least a portion of said lighter fraction of step (c) is recycled to said dehydrogenation zone.

9. A process for making a lube base stock according to claim 1 wherein skeleton isomerization is induced while the highly paraffinic feedstock is hydrotreated prior to step (a).

10. A process for making a lube base stock according to claim 1 wherein said olefinic feedstock has no more than 50% olefins.

11. A process for making a lube base stock according to claim 1 wherein said olefinic feedstock has from 10% to 50% olefins.

12. A process for making a lube base stock according to claim 10 wherein skeleton isomerization is induced during dehydrogenation step (a).

13. A process for making a lube base stock according to claim 1 wherein skeleton isomerization is induced during oligomerization step (b), or on the feedstock to said oligomerization step, or on the product of said oligomerization step.

14. A process for making a lube base stock according to claim 1 wherein said heavier fraction is hydrogenated.

15. A process for making a lube base stock according to claim 1 wherein said heavier fraction has a viscosity of greater than 4 cSt at 40° C. and a viscosity index of above 80.

16. A process for making a lube base stock according to claim 15 wherein said heavier fraction has a viscosity index of above 120.

17. A process for making a lube base stock comprising:

(a) producing a highly paraffinic feedstock by a Fischer-Tropsch process, wherein said highly paraffinic feedstock has boiling points within the range of from 258° to 1100° F. and has a paraffin content of at least 75 weight %;

(b) purifying said highly paraffinic feedstock;

(c) dehydrogenating said purified highly paraffinic feedstock in a dehydrogenation zone to produce an olefinic feedstock having from 10% to 50% olefins;

(d) oligomerizing said olefinic feedstock to produce an oligomerized product having a number average molecular weight at least 20% higher than that of the olefinic feedstock;

(e) hydrotreating said oligomerized product in a hydrotreatment zone;

(f) separating said hydrotreated oligomerized product into a lighter fraction and a heavier fraction, wherein said heavier fraction has a viscosity of greater than 4 cSt at 40° C., a viscosity index of above 120, and a flash point within the lube base oil range; and (g) recycling at least a portion of said lighter fraction to said dehydrogenation zone.

18. A process for making a lube base stock comprising:

(a) producing a highly paraffinic feedstock by a Fischer-Tropsch process, wherein said highly paraffinic feedstock has boiling points within the range of from 258° to 1100° F. and has a paraffin content of at least 75 weight %;

(b) purifying said highly paraffinic feedstock;

(c) dehydrogenating said purified highly paraffinic feedstock in a dehydrogenation zone to produce an olefinic feedstock having from 10% to 50% olefins;

(d) oligomerizing said olefinic feedstock to produce an oligomerized product having a number average molecular weight at least 20% higher than that of the olefinic feedstock;

(e) separating said oligomerized product into a lighter fraction and a heavier fraction, wherein said heavier fraction has a viscosity of greater than 4 cSt at 40° C., a viscosity index of above 120, and a flash point within the lube base oil range;

(f) recycling at least of portion of said lighter fraction to said dehydrogenation zone; and (g) hydrotreating said heavier fraction in a hydrotreatment zone.

19. A hydrocarbon in the lube base oil range produced by the process comprising:

(a) dehydrogenating a highly paraffinic feedstock, with boiling points within the range of from 258° to 1100° F., in a dehydrogenation zone to produce an olefinic feedstock;

(b) oligomerizing said olefinic feedstock to produce an oligomerized product having a higher number average molecular weight than the olefinic feedstock; and (c) separating said oligomerized product into a lighter fraction and a heavier fraction, wherein said heavier fraction has a flash point within the lube base oil range.

* * * * *